US008660458B2

(12) United States Patent
Akiyama

(10) Patent No.: US 8,660,458 B2
(45) Date of Patent: Feb. 25, 2014

(54) IMAGE FORMING APPARATUS HAVING A DETACHABLE TONER PARTICLE COLLECTING UNIT

(75) Inventor: Osamu Akiyama, Tama (JP)

(73) Assignee: Konica Minolta Business Technologies, Inc. (JP)

( * ) Notice: Subject to any disclaimer, the term of this patent is extended or adjusted under 35 U.S.C. 154(b) by 448 days.

(21) Appl. No.: 12/912,619

(22) Filed: Oct. 26, 2010

(65) Prior Publication Data

US 2011/0103821 A1 May 5, 2011

(30) Foreign Application Priority Data

Nov. 2, 2009 (JP) ..... 2009-251781

(51) Int. Cl.
*G03G 15/00* (2006.01)

(52) U.S. Cl.
USPC ..... 399/93; 399/99

(58) Field of Classification Search
USPC ..... 399/91–93, 98, 99
See application file for complete search history.

(56) References Cited

U.S. PATENT DOCUMENTS

| | | | | |
|---|---|---|---|---|
| 5,028,959 | A * | 7/1991 | Gooray | 399/93 |
| 5,349,427 | A * | 9/1994 | Benedict et al. | 399/360 |
| 5,521,690 | A * | 5/1996 | Taffler et al. | 399/93 |
| 6,480,685 | B2 * | 11/2002 | Jones et al. | 399/98 |
| 7,428,398 | B2 | 9/2008 | Zirilli | 399/253 |
| 2004/0250374 | A1 * | 12/2004 | Park et al. | 15/353 |
| 2008/0240779 | A1 * | 10/2008 | Ogashiwa | 399/119 |
| 2009/0255401 | A1 * | 10/2009 | Hunter et al. | 95/54 |

FOREIGN PATENT DOCUMENTS

| | | |
|---|---|---|
| JP | 04-223484 | 8/1992 |
| JP | 04-242778 | 8/1992 |
| JP | 08-194422 | 7/1996 |
| JP | 10-105015 | 4/1998 |
| JP | 11-258969 | 9/1999 |
| JP | 2003-084633 | 3/2003 |
| JP | 2006-091585 | 4/2006 |
| WO | WO 2007/104141 | 9/2007 |

OTHER PUBLICATIONS

Notice of Reasons for Refusal issued by JPO, drafted Jun. 28, 2013 in connection with appl. No. JP2009-251781, 3 pgs.
Translation of the Notice of Reasons for Refusal issued by JPO, drafted Jun. 28, 2013 in connection with appl. No. JP2009-251781, 4 pgs.

* cited by examiner

*Primary Examiner* — Walter L Lindsay, Jr.
*Assistant Examiner* — Jessica L Eley
(74) *Attorney, Agent, or Firm* — Squire Sanders (US) LLP

(57) ABSTRACT

An image forming apparatus includes a first air flow duct for guiding air including flying toner particles created in the image forming apparatus, a second air flow duct having a fan for exhausting cleaned air to an exterior of the image forming apparatus, and a toner particle collecting unit arranged between the first air flow duct and the second air flow duct. The toner particle collecting unit includes a cyclone separator including a cyclone main body, an air flow inlet, and an outlet tube. The cyclone separator centrifuges the toner particles from the air including toner particles and exhausts the cleaned air through the outlet tube. The apparatus further includes a toner particle collection box, mounted under the cyclone separator, and an air channel section for guiding the cleaned air from the outlet tube to the second air flow duct. The toner particle collecting unit is detachable.

18 Claims, 12 Drawing Sheets

IMAGE FORMING APPARATUS HAVING A DETACHABLE TONER PARTICLE COLLECTING UNIT

CROSS REFERENCE TO RELATED APPLICATION

This application is based on Japanese Patent Application No. 2009-251781 filed on Nov. 2, 2009 with the Japanese Patent Office, the entire content of which is hereby incorporated by reference.

TECHNICAL FIELD

The present invention relates to an image forming apparatus, controlled by the dry electro-photographic method, having a detachable unit to collect toner particles.

BACKGROUND ART

Concerning the image forming apparatuses controlled by the dry electro-photographic method, electrostatic latent images formed on a photoconductor are developed by toner to be toner images, wherein said toner images are, directly or through an intermediate transfer body, transferred onto a recording sheet. After that, the toner particles remaining on the surface of the photoconductor are removed by a cleaning device. Toner particles tend to fly or drop during the development process, transfer process, and cleaning process, which cause pollution within the apparatus, so that such pollutants have become a major problem.

To overcome the flying or dropping toner particles, Patent Document 1 discloses a technology, in which a suction hole for the flying toner particles is provided on an outlet of the developing device, and the suctioned toner particles are filtered by a filter to be collected. Since the filter is exchangeable, a clogged filter is exchanged for new one.

However, in large and high-speed image forming apparatuses, there are a large number of flying toner particles or dropping toner particles (hereinafter, referred to as "flying toner particles"), so that the structure to collect the flying toner particles by the filter as shown in Patent Document 1 tends to result in a clogged filter to be exchanged. In order to exchange the clogged filter, the service person is requested to visit an office having the large and high-speed image forming apparatuses, which results in low productivity.

Further, Patent Document 2 discloses that ducts are provided on an inlet and an outlet of the developing device, and the flying toner particles, suctioned by these duct, are classified through a cyclone separator into toner particles, exhibiting predetermined large sizes to be used again, and toner particles, exhibiting undesired sizes, whereby the toner particles, to be used again, are returned to the developing device, and the toner particles, exhibiting undesired sizes, are sent to a filter.

Still further, since the flying toner particles are created in the cleaning device, Patent Document 3 discloses a technology in which aerial flow, carrying the flying toner particles created by the cleaning device, is supplied to the cyclone separator, and the flying toner particles are separated from the aerial flow to be recovered by a collection box, and the aerial flow is exhausted through the filter.

Still further, Patent Document 4 discloses a technology, in which aerial flow, carrying the flying toner particles created by the developing device and the cleaning device, is sent to a cyclone separator.

Patent Document 1: Unexamined Japanese Patent Application Publication 04-223484:

Patent Document 2: U.S. Pat. No. 7,428,398;

Patent Document 3: Unexamined Japanese Patent Application Publication 08-194422; and Patent Document 4: Unexamined Japanese Patent Application Publication 2006-91585.

Concerning the productivities of the image forming apparatuses, the technologies disclosed in Patent Documents 2-4 are more effective than the technology disclosed in Patent Document 1. Because, by the cyclone separators of Patent Documents 2-4, the air flow, carrying the flying toner particles, is introduced in a cyclone main body in a tangential direction, whereby the flying toner particles are separated from the air by the swirl flow, and toner particles are collected into the collection box from a lower section of the cyclone main body. Accordingly, the toner particles, carried by the air flow, moving to the filter from the cyclone separator, are extremely reduced in quantity, and the filter tends not to be clogged.

However, according to the technologies disclosed in Patent Documents 2-4, the cyclone separators are fixed into the image forming apparatuses, so that the toner particle collection boxs and the filters have to be separated from the image forming apparatuses for cleaning. During the separating work, the toner particles tend to drop from the connecting sections between the cyclone separators, or the filters.

Further, to fix the cyclone separator within the apparatus may be effective to separate the toner particles in the cyclone separator, however, the toner particles actually and adversely adhere to the inner surface of the cyclone separator, so that, the toner particles accumulate in the cyclone separator and air channels.

SUMMARY OF THE INVENTION

An object of the present invention is to offer an image forming apparatus, using the dry electro-photographic method, wherein said image forming apparatus is configured to have effective maintenance characteristics against the flying toner particles, and to include the toner particle collecting unit using the cyclone method, so that the toner particle collecting efficiency is increased, whereby the toner particle collecting unit, including the cyclone separator, is configured to be exchanged for the maintenance work, so that the flying toner particles are prevented from adhering to the image forming apparatus during the maintenance work.

To achieve at least one of the abovementioned objects, an image forming apparatus reflecting one aspect of the present invention comprises:

a first air flow duct for guiding air including flying toner particles created in the image forming apparatus;

a second air flow duct having a fan for exhausting cleaned air to an exterior of the image forming apparatus; and a toner particle collecting unit arranged between the first air flow duct and the second air flow duct, wherein the toner particle collecting unit includes:

a cyclone separator including:

a cyclone main body;

an air flow inlet, connected to the first air flow duct, for flowing the air including toner particles in a tangential direction of an inner surface of an upper portion of the cyclone main body; and an outlet tube for exhausting the cleaned air, from which the toner particles have been separated, from a center of the upper portion of the cyclone main body, wherein the cyclone separator is configured to centrifuge the toner particles from the air including toner particles due to swirl flow generated in the cyclone main body, and exhausts the cleaned air through the outlet tube;

a toner particle collection box, mounted under the cyclone separator, for containing the toner particles having been separated from the air including toner particles; and an air channel section for guiding the cleaned air from the outlet tube to the second air flow duct;

wherein the toner particle collecting unit is structured to be detachable from the image forming apparatus.

Based on the present invention, since the toner particle collecting unit has the cyclone separator method, the toner particle collecting efficiency is very high, and the cyclone separator and the toner particle collection box are integrally drawn out from the image forming apparatus, whereby no toner particles drop within the image forming apparatus.

BRIEF DESCRIPTION OF THE DRAWINGS

Embodiments will now be detailed, by way of example only, with reference to the accompanying drawings which are meant to be exemplary, not limiting, and wherein like embodiments are numbered alike in the several figures, in which:

FIG. 2 is a schematic view explaining the schematic structure of Embodiment 1 of the present invention, wherein

FIG. 4 shows a detailed structure of the toner particle collecting unit of Embodiment 1, in which

FIG. 7 is a schematic view explaining the schematic structure of Embodiment 2 of the present invention, wherein

FIG. 9 is a schematic view to show the accumulated toner particles, wherein FIG. 9*a* shows a structure using a funnel-shaped cyclone separator, while

FIG. 10 is a drawing to explain a vortex table, wherein

FIG. 13 shows various baffles, wherein

FIG. 15 shows sealing members, wherein

DETAILED DESCRIPTIONS OF THE PREFERRED EMBODIMENTS

Figure 1:
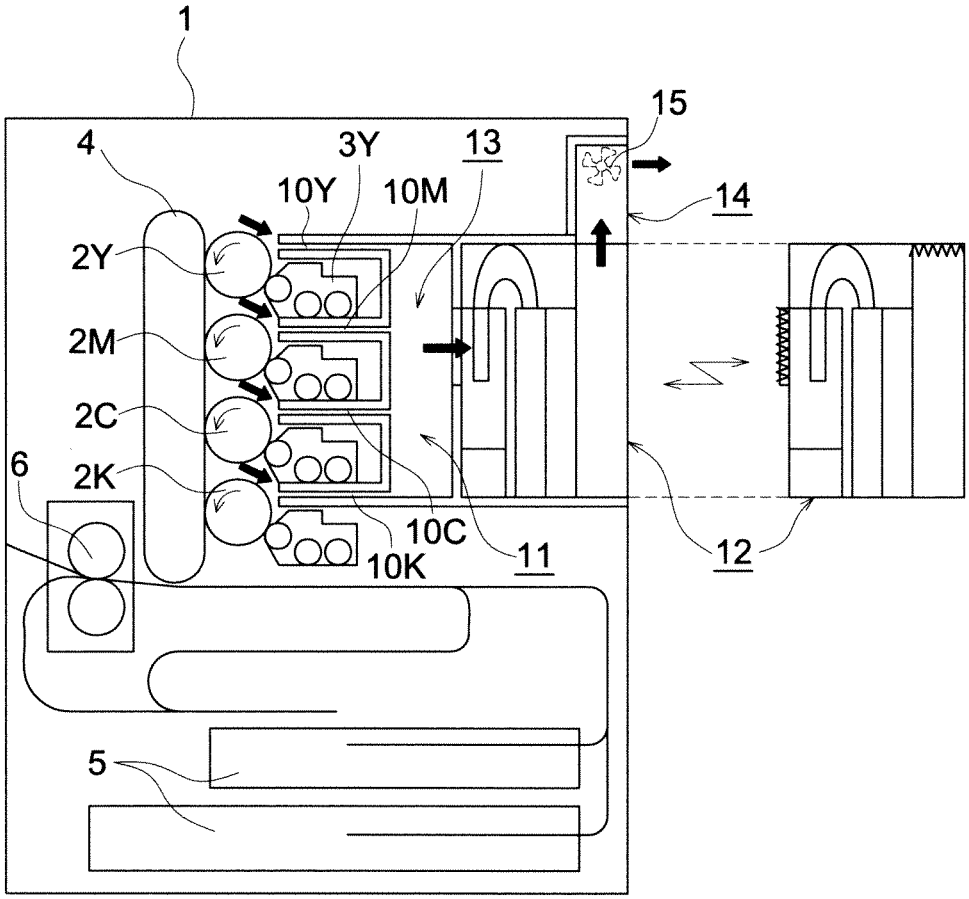
FIG. 1 is a schematic view showing the total structure of the image forming apparatus relating to the present invention.

FIG. 1 is a schematic view to show the total structure of an image forming apparatus to which the present invention applies. This image forming apparatus is a tandem-type full color image forming apparatus, wherein toner images of yellow (Y), magenta (M), cyan (C), and black (K) are individually formed on four photosensitive drums, these toner images are subsequently superposed on an intermediate transfer body, then the superposed toner images are transferred onto a recording sheet. However, since the present invention is not limited to this method, the present invention can be applied to image forming apparatuses employing various methods.

In FIG. 1, four photosensitive drums 2Y, 2M, 2C and 2K are vertically aligned, which are rotated counterclockwise, and four developing devices 3Y, 3M, 3C and 3K are arranged to face photosensitive drums 2Y, 2M, 2C and 2K, individually (in FIG. 1, only symbol 3Y is shown).

Upstream of each developing device of each photosensitive drum, a cleaning device, an electrostatic charging device, and an exposure device are arranged, which are not shown in FIG. 1. Photosensitive drums 2Y, 2M, 2C and 2K are in contact with intermediate transfer belt 4, which rotates clockwise. A primary transfer device (which is not illustrated) is arranged to face each developing device, mounted within the interior of intermediate transfer belt 4.

Each color toner image is formed on a photosensitive drum for each color, by the electrostatic charging device, exposure device, and developing device, whereby the formed color image of each color is transferred to be superposed on intermediate transfer belt 4, by the primary transfer device. Subsequently, superposed color toner images are secondarily transferred onto a recording sheet, supplied from sheet supplying device 5, mounted at the bottom of image forming apparatus 1. After that, the recording sheet is conveyed to fixing device 6 which permanently fixes the full color image, and the recording sheet is exhausted to the exterior of image forming apparatus 1.

On image forming apparatus 1, structured above, air suction ducts 10Y, 10M, 10C, and 10K, to vacuum flying toner particles, are mounted above the developing devices (upstream of the position where the developing devices face the photosensitive drums). Air suction ducts 10Y, 10M, 10C, and 10K are combined to common duct 11.

Common duct 11 additionally functions as a supporting plate to detachably support toner particle collecting unit 12, which is to be detailed later. Toner particle collecting unit 12, housed in common duct 11, can be drawn out from the side of image forming apparatus 1, as shown in FIG. 1.

Air suction ducts 10Y, 10M, 10C and 10K, and common duct 11, all of which structures first duct 13, are mounted in image forming apparatus 1. Further, image forming apparatus 1 includes second duct 14 above toner particle collecting unit 12. Said second duct 14 has air blow fan 15 to blow out the air which has been cleaned by toner particle collecting unit 12, to the exterior of image forming apparatus 1.

Figure 2C:
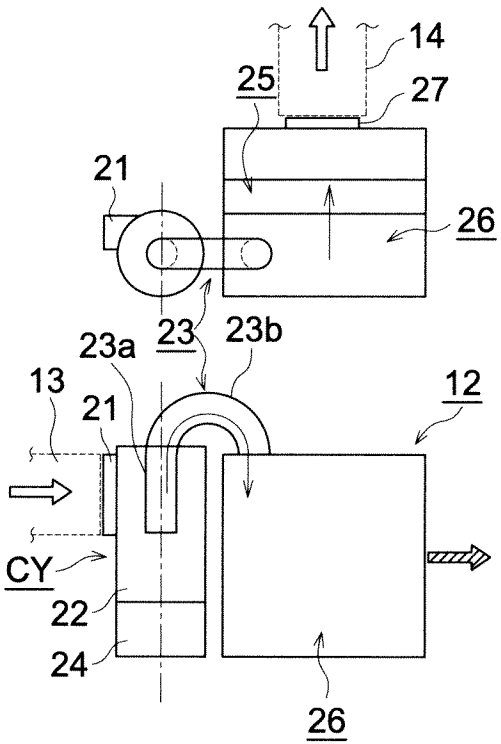
FIGS. 2*b* and 2*c* show variations of Embodiment 1.
Figure 2B:
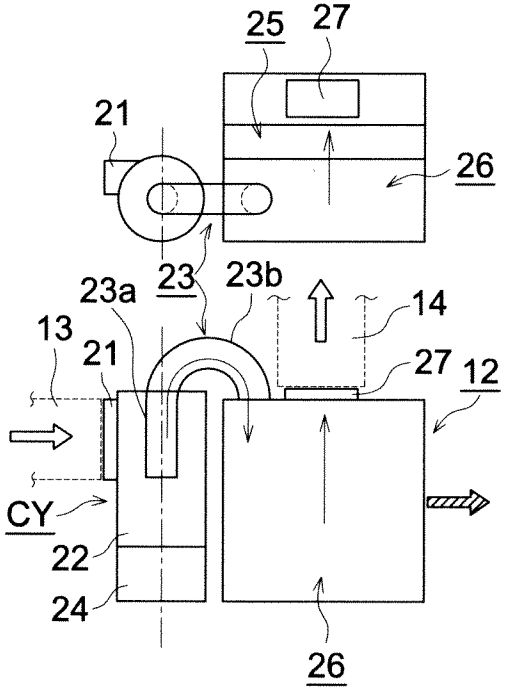
Figure 2A:
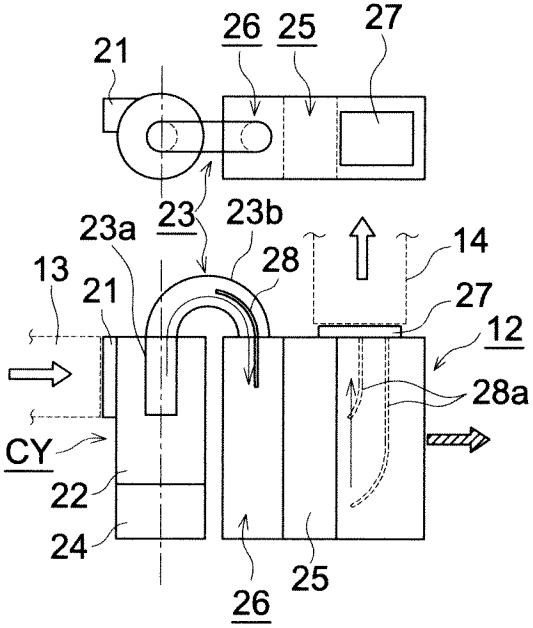
FIG. 2*a* shows Embodiment 1.

FIG. 2*a* is a drawing to detail toner particle collecting unit 12 of Embodiment 1, the upper half of FIG. 2*a* shows a top view, and a lower half of FIG. 2*a* shows a side view. Toner particle collecting unit 12 is structured of air flow inlet 21 to vacuum the air carrying the flying toner particles, cyclone main body 22, being cylindrical, cyclone outlet tube 23 to discharge the air upward from the center of the top of cyclone main body 22, toner particle collection box 24, mounted at the bottom of cyclone main body 22, which stores the toner particles, air channel 26 having filter 25, and air outlet 27, being a connecting section to second duct 14.

In the preferred embodiment, hereinafter, air flow inlet 21, cyclone main body 22, and cyclone outlet tube 23 are totally or commonly referred to as cyclone separator CY.

Cyclone main body 22 includes a cylindrical axis, which is arranged in the vertical direction, accordingly, cyclone main body 22 is arranged in the gravitational direction. Though the arrangement in the gravitational direction is not an essential feature, this is the most suitable arrangement, in order to separate the toner particles from the air by gravitational force.

Through air flow inlet 21, the air, including the flying toner particles, is sent from first duct 13 to the top of cyclone main body 22, wherein said air is sent tangentially to the inner periphery of cyclone main body 22. Said air generates swirl flow in cyclone main body 22. The toner particles carried in the swirl flow are shifted in the radius direction by centrifugal force, so that the flying toner particles are separated from the air. Separated toner particles are sent downward by their own weight, and enter toner collection box 24. The air, no longer carrying the flying toner particles, is sent from cyclone outlet tube 23 to air channel 26, and exhausted to the exterior of apparatus 1 from the opening of second duct 14.

Cyclone outlet tube 23 is structured to send the air, from which the toner particles have been separated, from cyclone main body 22 to air channel 26. Cyclone outlet tube 23 includes outlet tube 23*a*, whose axis matches the axis of cyclone outlet tube 23. In Embodiment 1, U-shaped pipe 23*b* is connected to outlet tube 23*a*, whereby U-shaped tube sends the air from cyclone main body 22 to air channel 26, while the air flow is reversed. Filter 25 is arranged in air channel 26 to filtrate the toner particles, so that extremely small amounts of the toner particles, remaining in the air, can be collected, and the air is effectively cleaned. Plural filters 25 make cleaning efficiency more effective.

To conduct centrifugal separation to separate the toner particles by the swirl flow, cyclone separator CY requires enough vertical length in the rotating direction of the swirl flow. Filter 25 is arranged to match the vertical length parallel to cyclone separator CY, so that filter 25 is shaped to be vertically long. Cyclone outlet tube 23 is U-shaped, and the air is introduced parallel to the filter surface, whereby, the air speed at the top of filter 25 and the air speed at the bottom of filter 25 become nearly equal, so that the total surface of filter 25 can be effectively used to filtrate the air.

Further, in order to make the speed at the top and bottom of filter 25 to be more even, air flow rectifying plate 28 is provided in cyclone outlet tube 23. Air flow rectifying plate 28 is a long plate, extending from the center of cyclone outlet tube 23 to the top of air channel 26, whereby the air, flowing out from cyclone outlet tube 23, is separated into two parts. If said air flow rectifying plate 28 is not used, the air, flowing out from cyclone outlet tube 23, is introduced to only the top of filter 25. However, since air flow rectifying plate 28 is used, the air volume, flowing above filter 25 and flowing below filter 25, become equal, whereby the speed of the air, passing through filter 25, becomes uniform.

In addition, if there is a space at a downstream portion of filter 25, air flow rectifying plate 28 can be arranged more downstream of filter 25, as shown in FIG. 2*a*.

FIGS. 2*b* and 2*c* show variations of FIG. 2*a*, and include the top view and the side view, in the same way as in FIG. 2*a*. Concerning the structure of the variation in FIG. 2*b*, air channel 26 is extended wider than that of FIG. 2*a*, and filter 25 is arranged to be parallel to the sheet surface of FIG. 2. Accordingly, the air, having been cleaned, is sent from air outlet 27, provided at the top of channel 26, to second duct 14.

Concerning the structure of the variation in FIG. 2*c*, second duct 14 is arranged on the back of air channel 26, wherein air channel 26 has been extended as shown in FIG. 2*b*. Accordingly, air channel 27 is arranged at the side of air channel 26. Between the above-detailed variations, a desired variation can be selected, based on the mechanical structure of the image forming apparatus.

Figure 3:
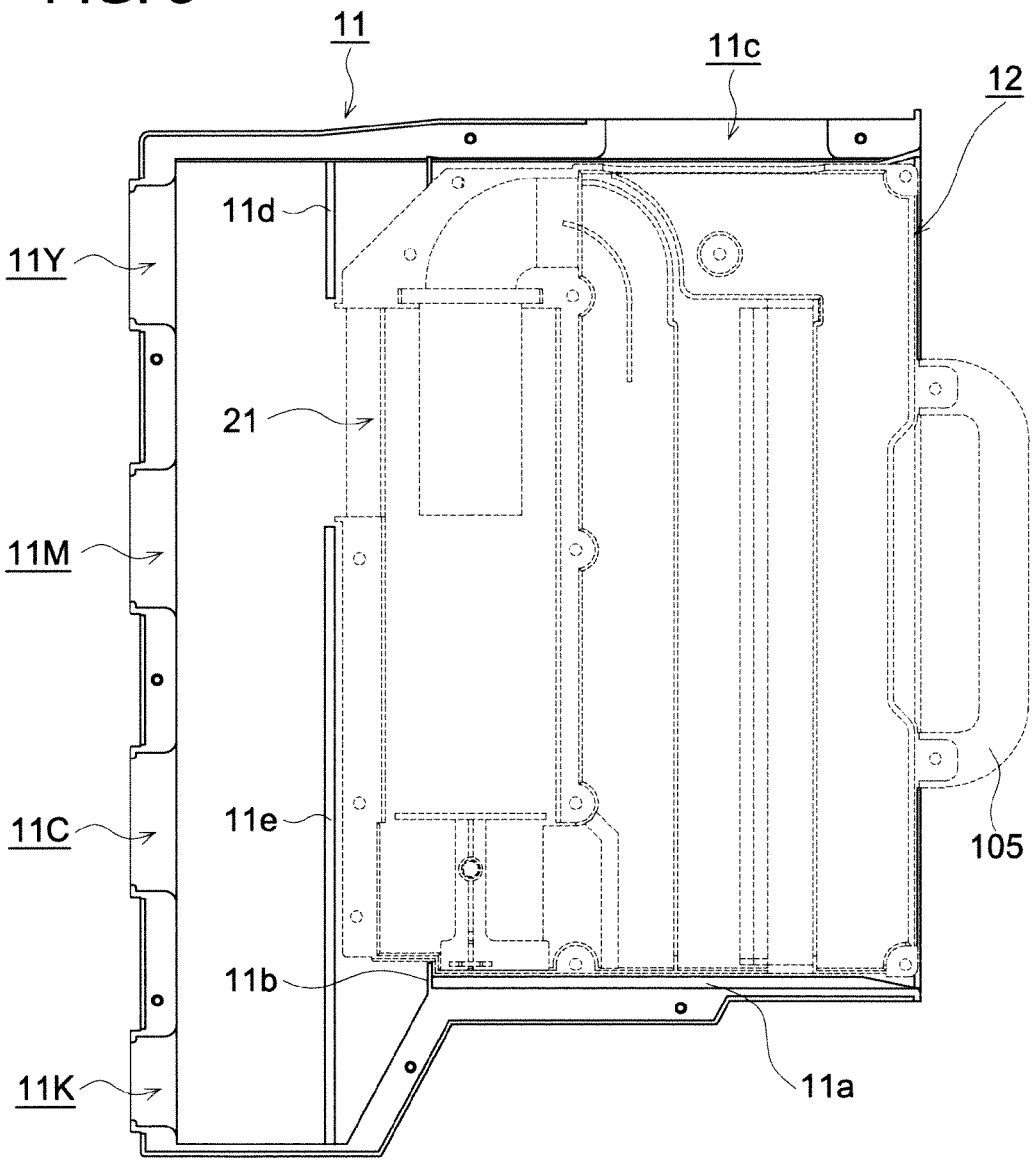
FIG. 3 is a plan view showing a detailed structure of Embodiment 1.

FIGS. 3 and 4 show more detailed structures of Embodiment 1, shown in FIG. 2*a*. In Embodiment 1, common duct 11 and toner particle collecting unit 12 are individually manufactured to be two divided blocks, and assembled. That is, common duct 11 and toner particle collecting unit 12 are structured of two sections, which are cross-sectioned at the center axis of cyclone separator CY, by a surface including the sheets of FIGS. 1 and 2.

FIG. 3 is a plan view to detail half of common duct 11, and toner particle collecting unit 12 included therein (shown by the dotted lines). FIG. 3 shows one of two divided sections of common duct 11 and toner particle collecting unit 12. Since the divided sections are nearly symmetrical, they can be assembled to be one unit by the screws shown by the circle marks in FIG. 3.

Common duct 11 includes openings 11Y, 11M, 11C, and 11K, connected to suction ducts 10Y, 10M, 10C, and 10K, respectively. Accordingly, the air, including the toner particles, can be sent from openings 11Y, 11M, 11C, and 11K, to air flow inlet 21 of toner particle collecting unit 12. In addition, walls 11*d* and 11*e* are barriers to make said air enter only through air flow inlet 21, whereby the toner particles cannot adhere to the outer surface of toner particle collecting unit 12.

Bottom portion 11*a* of common duct 11 functions as a supporting plate for toner particle collecting unit 12, on the back of which stopper 11*b* is formed. Further, opening 11*c* is provided to connect to second duct 14, on the top of toner particle collecting unit 12. In addition, wall 11 and stopper 11*b* are not always necessary for the present Embodiment.

Figure 4A:
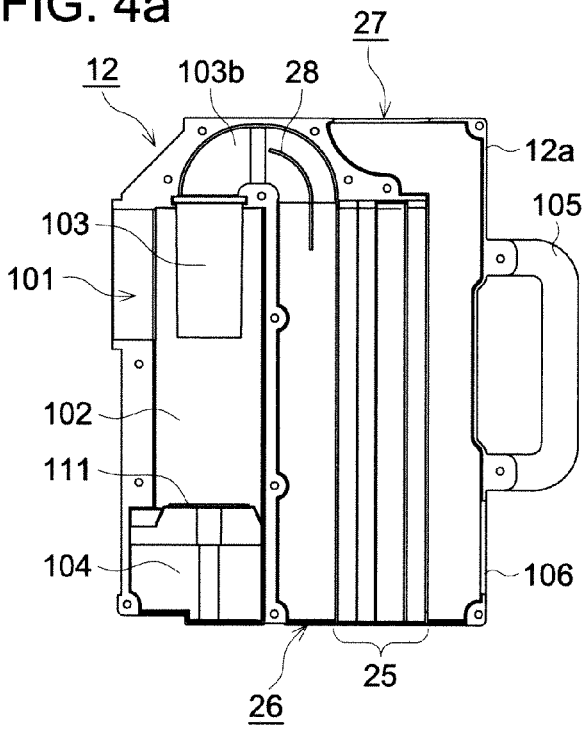
FIG. 4*a* is a plan view showing a half structure of the unit.
Figure 4C:
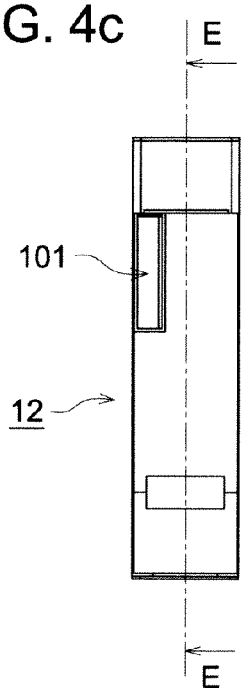
FIG. 4*c* is a side view of the toner particle collecting unit.
Figure 4B:
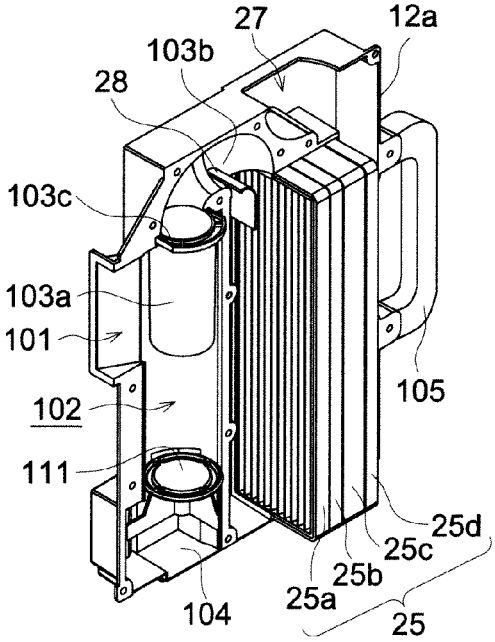
FIG. 4*b* is a perspective top view of FIG. 4*a*.
Figure 4D:
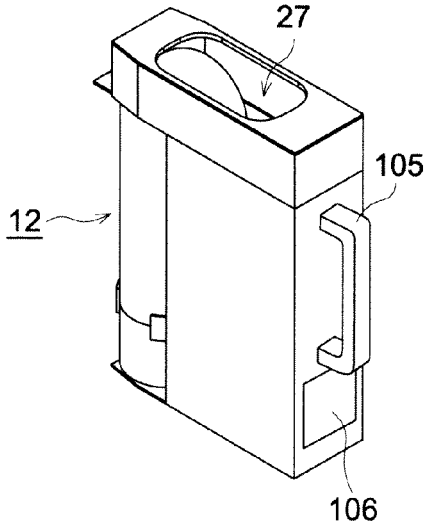
FIG. 4*d* is a total perspective view of the total particle collecting unit.

FIG. 4 shows toner unit collecting unit 12, shown by the dotted lines in FIG. 3, wherein FIG. 4*a* is the plan view of unit 12*a*, being one of the divided unit, FIG. 4*b* is a perspective view of unit 12*a*, FIG. 4*c* is a side view of toner particle collecting unit 12, and FIG. 4*d* is a perspective view of toner particle collecting unit 12.

Toner particle collecting unit is structured to be separated by line E-E in FIG. 4*c*. FIGS. 4*a* and 4*b* show half of the toner particle collecting unit, installed in the back of image forming apparatus, which represents unit 12*a*, being the back unit. Unit 12*a* has air flow inlet 21, while the other unit does not, which is a different structure.

These two units are formed of plastic molding, being solid members, so that when said units are removed from the image forming apparatus, even though the units are undesirably dropped by the operator, they do not break to scatter toner particles. Polypropylene or polycarbonate is used as the plastic material. Since said polycarbonate is transparent, which is suitable for observing the toner particles adhered to the inner section. In addition, common duct 11 is also formed of plastic members.

To form common duct 11 of the plastic molding, the frictional electrification order should be studied, so that a plastic member, on which toner particles do not tend to adhere, can be selected. Otherwise, an electrification preventing member is effectively coated on the inner surface of common duct 11. However, to form toner particle collecting unit 12, being a detachable unit, of the plastic molding, a plastic material, to which the toner particles tend to adhere, should be selected.

In FIG. 4, cyclone main body 102 is formed to be a hollow, wherein a cylinder is cut along the center axis to form the hollow. Toner particle collection box 104 has a circular opening to connect to cyclone main body 102, and a square-shaped area to accommodate the toner particles.

Cylindrical outlet tube 103*a* is inserted into the top of cyclone main body 102. In detail, flange 103*c* of outlet tube 103*a* is inserted into a concave groove (see FIG. 4*b*). U-shaped pipe 103*b* is connected to the top of toner particle collecting unit 12, so that the air flow is introduced into air flow channel 26. Cyclone separator outlet tube 103 is structured of U-shaped pipe 103*b* and outlet tube 103*a*. Air flow rectifying plate 28 is mounted on an area from pipe 103*b* to the top of air flow channel 26.

Vortex table 111 is formed on a border portion between cyclone main body 22 and toner particle collection box 104. Said plate 111 and container 104 are individually produced and assembled.

Slots are formed to insert plural filters. FIG. 4*b* shows that filter 25 is inserted into the slot of toner collecting unit 12*a*, being a half unit.

Handle 105 is mounted on a side wall of air flow channel 26, and transparent window is mounted below said handle 105.

Handle 25 is mounted to draw out toner particle collecting unit 12 from the image forming apparatus, so that its shape is not limited to the illustration in FIG. 4*c*1, as long as it is convenient to use.

Filters 25, which is used in the present embodiment, include two toner-proof filters 25*a* and 25*b*, a single ozone catalytic filter 25*c*, and a single toner-proof filter 25*d*, from the cyclone separator in the above assembling order. Generally, ozone catalytic filter 25*c* is usually assembled at the most downstream of the air flow, however, in the present embodiment, toner-proof filter 25*d* is assembled there instead. Because, after the operator opens the side door of the image forming apparatus, the operator can visually check toner-proof filter 25*d*, carrying the toner particles, with eyes, through the transparent window 106, and determines whether to replace toner collecting unit 12.

By the cyclone separating method, almost all toner particles are effectively caught in toner particle collection box 104, but very few toner particles pass through the cyclone separator, and then reach toner-proof filter. If toner-proof filter 25, which is located at the most downstream among the filters, becomes dusty with the toner particles, the operator understands that toner particle collection box 104 is clogged with toner particles. It means that, the toner collecting efficiency of the cyclone separator has been reduced, so that toner particles adversely reach the filters. Accordingly, the operator can determine whether to replace toner particle collecting unit 12 or not, by checking a dusty condition of toner-proof filter 25*d*, serving as the most downstream filter. Therefore, without removing toner particle collecting unit 12, the operator can understand timing to replace toner particle collecting unit 12, whereby the apparatus is not soiled with the toner particles.

In addition, transparent window 106 is formed on the front surface of toner particle collecting unit 12, but if it is formed of polycarbonate, said unit 12 can be totally transparent, which is very visible for the operator.

To check for dust on the toner-proof filter, a transparent window can be applied not only to the preferred embodiment of the present invention, but also to the technology in which the air carrying the toner particles is directly guided from the duct to the filter chamber, and further to the technology in which the air carrying the toner particles is guided from the cyclone separator, being fixed on the apparatus, to the filter chamber. When the above described filter chamber becomes dirty with toner particles, it is removed from the image forming apparatus and exchanged for a new one. To determine the timing for exchanging the filter, the operator checks the filter through the transparent window.

Figure 5:
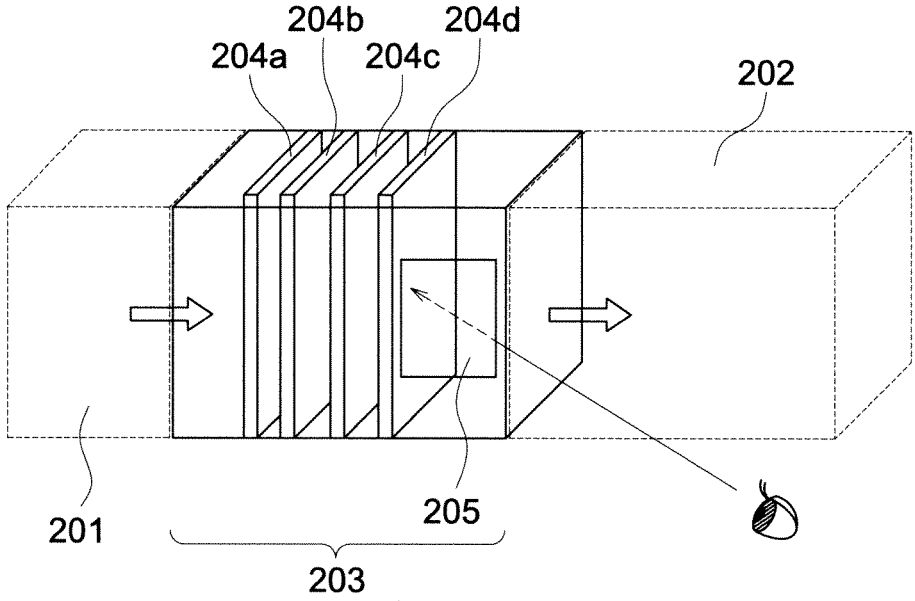
FIG. 5 shows a transparent window to view the toner particle-proof filter, wherein the air including the toner particles is directly introduced from a duct to a filter chamber.

FIG. 5 shows the transparent window through which the operator checks the filter, wherein the air carrying the toner particles is directly guided from the duct to the filter chamber. First duct 201 and second duct 202, both depicted by dotted lines, are fixed to the image forming apparatus. First duct 201 guides the air carrying the toner particles from the developing device, while second duct 202 exhausts the air carrying the toner particles to the exterior of the apparatus using a fan, which is not illustrated. Detachable Filter unit 203 is mounted between first duct 201 and second duct 202, so that filter unit 203 can be pulled out to replace it.

Filter unit 203 includes two toner-proof filters 204*a* and 204*b*, a single ozone catalytic filter 204*c*, and a single toner-proof filter 204, these filters are arranged in this order from first duct 201. Transparent window 205 is arranged on the surface of filter unit 203, so that the operator can view the dusty condition of toner-proof filter 204*d*. By this structure, without removing filter unit 203, the operator can check the dusty condition of filter 204*d*, located at the most downstream position, whereby the operator can determine the timing to replace filter chamber 203.

Concerning Embodiment 1 as detailed above, the cyclone main body, the toner particle collection box, and the filters are drawn out together from the image forming apparatus, however, if a cyclone separator, exhibiting toner collecting efficiency of more than 99.99%, is used, no other filter is necessary. Even if a filter is used, the filter is fixed to the image forming apparatus, and said filter is not exchanged for a new one, which is Embodiment 2. In Embodiment 2, a cyclone separator and a toner particle collection box are configured to be integrally drawn out as toner collecting unit 300, which will be detailed while referring to FIGS. 6, 7, and 8.

Figure 6:
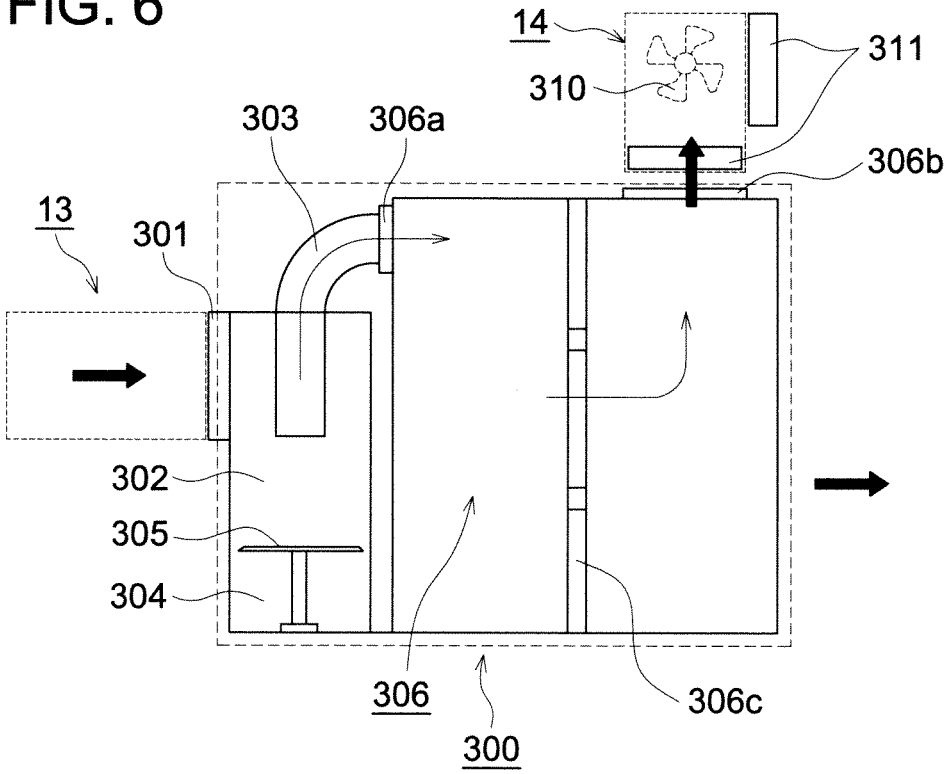
FIG. 6 is a schematic view explaining the schematic structure of Embodiment 2 of the present invention.

In FIG. 6, a filter of Embodiment 2 is fixed to the image forming apparatus. Dotted first duct 13 is connected to air flow inlet 301 of cyclone main body 302. The air, carrying stray toner particles, enters through air flow inlet 301, and is swirled in cyclone main body 302, after that, the air is exhausted through outlet tube 303, mounted on the top of cyclone main body 302. The toner particles, which have been centrifugally separated from the air, are accommodated in toner particle collection box 304. Vortex table 305 is mounted between cyclone main body 302 and toner particle collection box 304.

Outlet tube 303 is structured of a J-shaped pipe, so that the air, entering outlet tube 303, is directed to the right in FIG. 6, and is sent to air channel 306.

Air channel 306 is a rectangular container, including opening 306*a* to join outlet tube 303 of cyclone main body 302, and opening 306*b* to join second duct. Numeral 306*c* represents a reinforcement.

Fan 310 and filter 311 are provided in second duct 14. Since the toner collecting efficiency of cyclone main body 302 of Embodiment 2 is set so high that filter 311 functions to prevent the toner particles from adversely escaping to the exterior of second duct 14, as an unlikely event. Accordingly, filter 311 can be installed either upstream or downstream of fan 310.

In Embodiment 2, toner particle collecting unit 300 is integrally structured of cyclone main body 302, air flow inlet 301, outlet tube 303, toner particle collection box 304, and air channel 306.

Figure 7A:
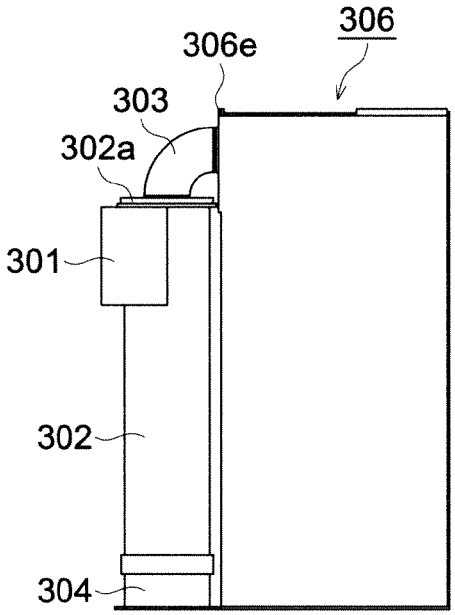
FIG. 7*a* is a front view.
Figure 7B:
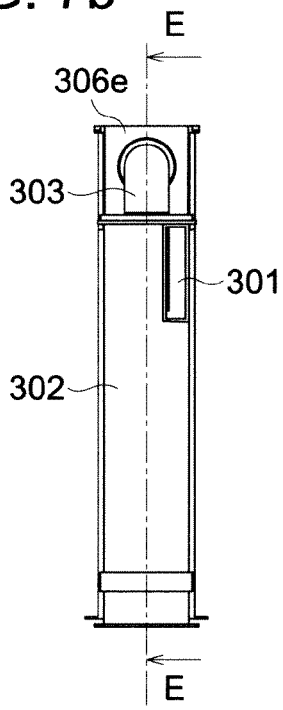
FIG. 7*b* is a side view.
Figure 7C:
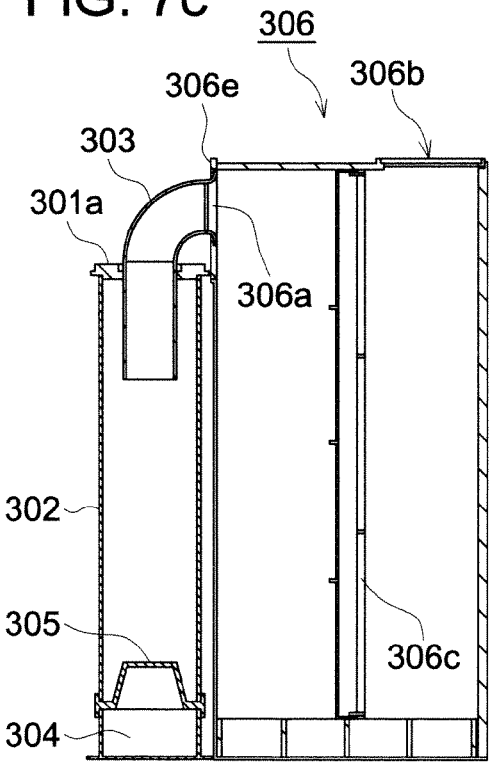
FIG. 7*c* is a cross-sectional view.
Figure 7D:
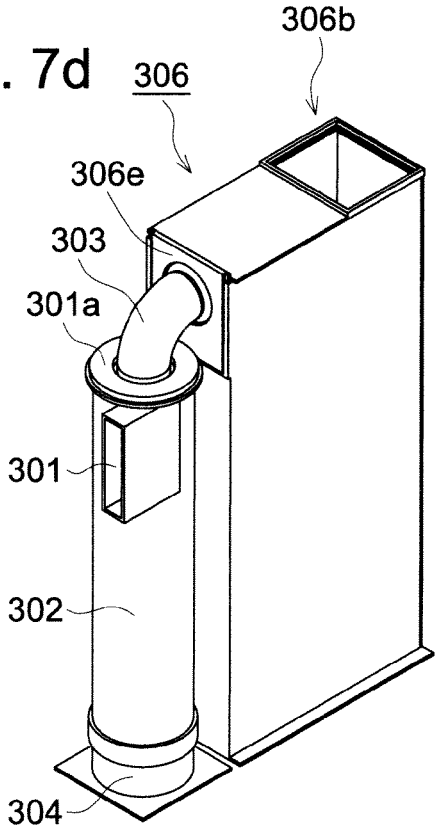
FIG. 7*d* is a perspective view.

FIG. 7 is a schematic view explaining the structure of Embodiment 2 shown in FIG. 6, wherein FIG. 7*a* is a front view, FIG. 7*b* is a side view, FIG. 7*c* is a cross-sectional view cut on line E-E, and FIG. 7*d* is a perspective view of Embodiment 2.

In FIG. 7, cyclone main body 302 has top cover 302*a* to cover the top of cyclone main body 302, and outlet tube 303 is supported on top cover 302*a*, so that outlet tube 303 is fixed at a predetermined position. On the top of cyclone main body 302, top cover 302*a*, mounted on outlet tube 303, is assembled, while on the bottom of cyclone main body 302, vortex table 305 and toner particle collection box 304 are assembled in this order. For such assembling works, snap fittings, press fittings, or adhering methods are used, so that they are firmly fixed.

Air channel 306 is structured of plural members. For plural members, as applied in Embodiment 1, two sections divided in the center can be used, or a box having an open surface and a cover for closing the other surface can be structured.

To join air channel 306 to outlet tube 303, a portion of air channel 306, to face outlet tube 303, is formed to be an inserting cover, that is, grooves are formed on the top of side plates of air channel 306, whereby inserting cover 306*e* is inserted into said grooves. An opening is provided on the center of inserting cover 306*e*, while the end of outlet tube 303 is structured to be a trumpet shape.

Outlet tube 303 is inserted into inserting cover 306*e*, whereby the end of outlet tube 303, having the trumpet shape, is firmly fixed onto inserting cover 306*e*. Outlet tube 303 and inserting cover 306*e*, both assembled, are inserted into the grooves of air channel 306. In addition, cyclone main body 302 and toner particle collection box 304 are joined to air channel 306 by a member which is not illustrated, so that cyclone main body 302, toner particle collection box 304, and air channel 306 can be integrally drawn out from the apparatus.

Otherwise, concerning Embodiment 2, using the center dividing structure like Embodiment 1, the cyclone main body, the toner particle collection box, and the air channel forming container can be molded to be a hollow shape.

Figure 8:
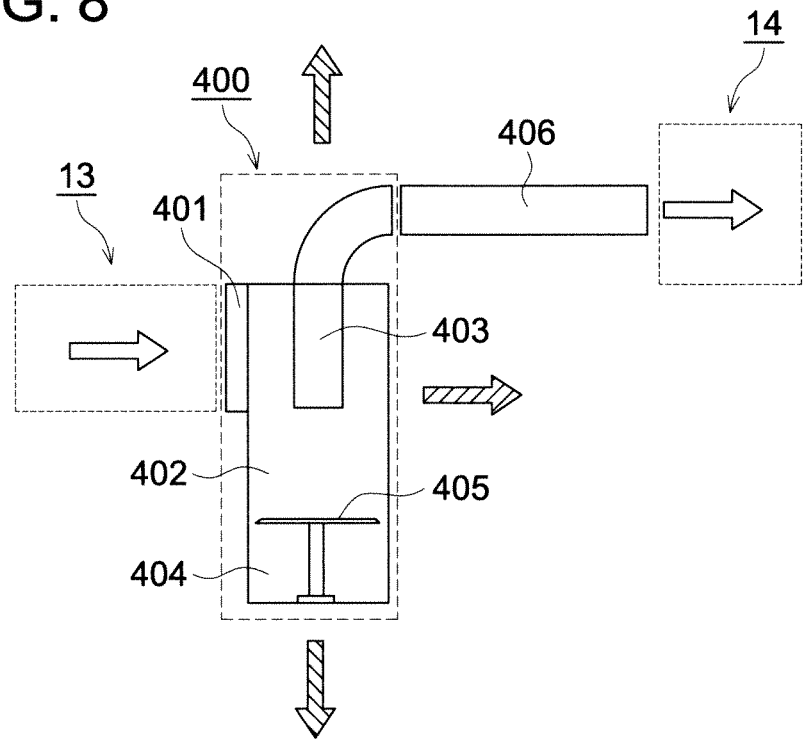
FIG. 8 is a schematic view to show a variation of Embodiment 2.

FIG. 8 is a schematic view to show a variation of Embodiment 2, wherein no filter is used. The air coming from cyclone separator 402 is guided to second duct 14, and exhausted to the exterior of the apparatus, so that said air does not pass through a filter. This variation can be used, when the toner collecting efficiency is extremely great.

Toner collecting unit 400 is structured of cyclone separator 402, J-shaped outlet tube 403, toner collecting container 404 and vortex table 405. Air flow inlet 401 of cyclone separator 402 is connected to first duct 13, while J-shaped outlet tube 403 is connected to second duct 14, through air channel molded pipe 406.

In this variation, the operator removes toner collecting unit 400 from the apparatus, by such ways that: once the operator raises said unit 400, then the operator pulls it out to remove it, once the operator lowers said unit 400, then the operator pulls it out to remove it, or once the operator pulls said unit 400 out, then the operator pushes it to the side of the apparatus to remove it, whereby air channel molded pipe 406 is not interrupted during the removing work. In FIG. 8, hatched arrows show removing directions of said unit 400. A removing direction can be selected, based on the space available within the image forming apparatus. Further, second duct 14 can be mounted on cyclone separator 403, while said cyclone separator 403 is formed to be a straight tube. Then the operator can pull cyclone separator 403 to the side of the apparatus to remove it, which is the same way as in Embodiment 1.

While referring to embodiments shown in FIGS. 9, 10, and 11, detailed will be the structure and functions of the cyclone separator, and the structure and functions of vortex table, which plate is mounted between the cyclone separator and the toner collecting container.

In the past, generally used cyclone separators CY were mostly formed to be cylindrical in their upper sections, while funnel shapes in their lower sections. Accordingly, the openings were so narrow that the toner particles could not be contained at the full volumes of toner particle collection boxs BX, being connected to the narrow openings. However, according to the preferred embodiment, cyclone separator CY is formed to be totally cylindrical, whereby the volume of collected toner particles is relatively increased.

Figure 9A:
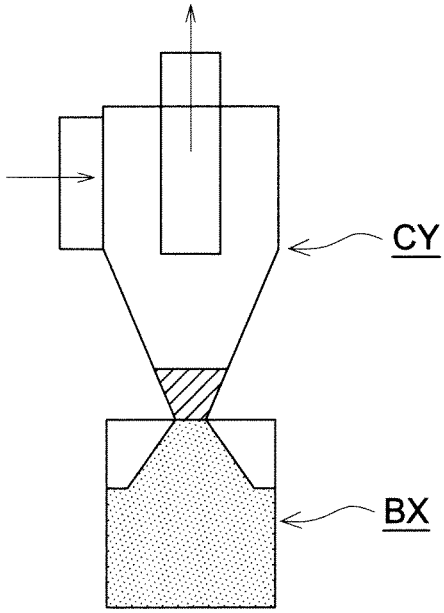

FIG. 9*a* shows cyclone separator CY, being the funnel shape, as the conventional use. In this case, the toner particles cannot be collected to fill toner particle collection box BX as shown by a shaded area in FIG. 9*a*. That is, toner particle collection box BX generates empty portions, being white areas, which are not filled with the toner particles, and the toner particles are accumulated in the bottom of cyclone separator CY, as illustrated by hatched lines, in FIG. 9*a*. Accordingly, said toner collecting container BX is ineffective.

Figure 9B:
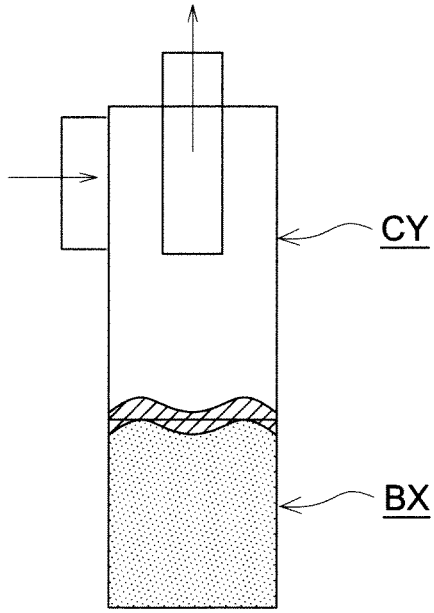
FIG. 9*b* shows a structure using a cylindrical cyclone separator.

In the present embodiment, as shown in FIG. 9*b*, cyclone separator CY is formed to be cylindrical, and an opening of toner collecting container BY is formed to exhibit the same diameter as the cyclone separator CY, whereby cyclone separator CY is connected to toner collecting container BY, using the same diameter. Accordingly, the total volume of toner collecting container BY can be filled with the collected toner particles.

However, in case that the above structure is used, the swirl flow tends to be unstable in cyclone separator CY, and the toner particles, having been collected in toner collecting container BX, may fly again in cyclone separator CY so that they may be conveyed to the outlet tube. To overcome this problem, vortex table VP is provided between cyclone separator CY and toner collecting container BX, in the present embodiment.

Figure 10A:
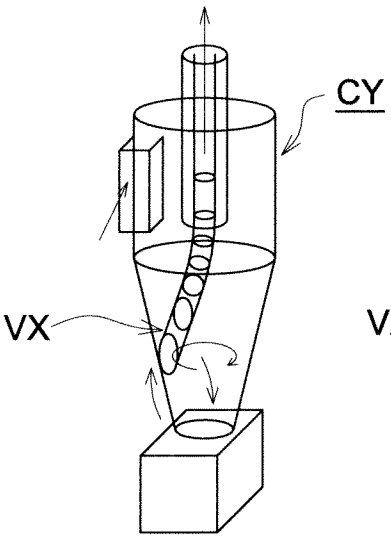
FIG. 10*a* shows a vortex in a normal cyclone separator.

FIG. 10*a* shows a vortex movement in a normal cyclone separator. The air is guided to enter the air flow inlet and rotates in cyclone separator CY so that swirl flow is generated in cyclone separator CY. The center of said swirl flow is referred to as vortex core VX. In case that the air flow is fast and unstable, the bottom portion of vortex core VX comes into contact with the inner surface of cyclone separator CY, to conduct the precession movement. The vortex table 305 stabilizes the bottom edge of the vortex core VX in swirl flow.

Figure 10B:
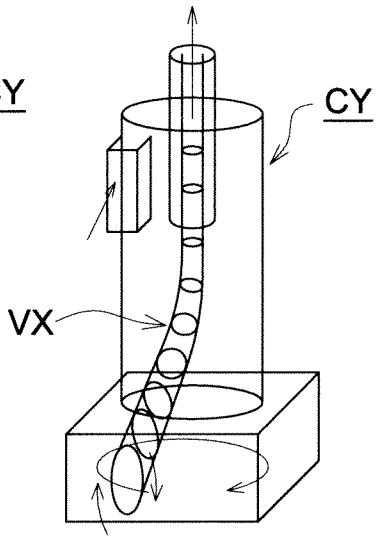
FIG. 10*b* shows the vortex flows in the cylindrical cyclone separator.

The toner particles, carried in the air, are centrifugally separated from the air by the swirl air, so that the toner particles are accumulated in toner particle collection box BX. In order to increase the volume of toner particles, accumulated in toner particle collection box BX, if the total shape of cyclone separator CY is formed to be cylindrical as shown in FIG. 10*b*, vortex core VX adversely drops into toner particle collection box BX. To prevent vortex core VX from dropping in container BX, and to stabilize the precession movement of vortex core VX, vortex table VP is provided in the present embodiment.

Figure 10C:
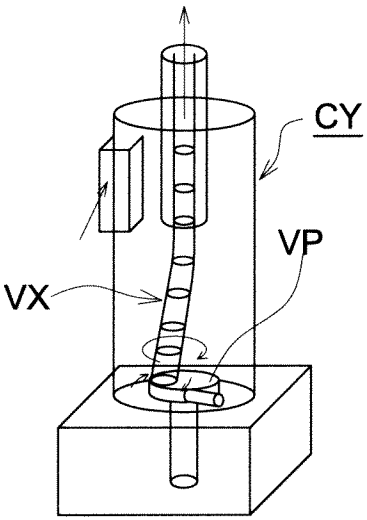
FIG. 10*c* shows the vortex table, applied on the cylindrical cyclone separator.

FIG. 10*c* shows a structure having vortex table VP. By this structure, vortex core VX conducts the precession movement on the surface of vortex table VP, so that the swirl flow becomes stable. Further, since the lower end of vortex core VX does not enter toner particle collection box BX, the accommodated toner particles are prevented from flying again. The toner particles in the swirl flow move outward due to the centrifugal force, and then downward by their own weight. After that, they are recovered into toner particle collection box BX, through the clearance between vortex table VP and the opening of toner particle collection box BX.

Figure 10D:
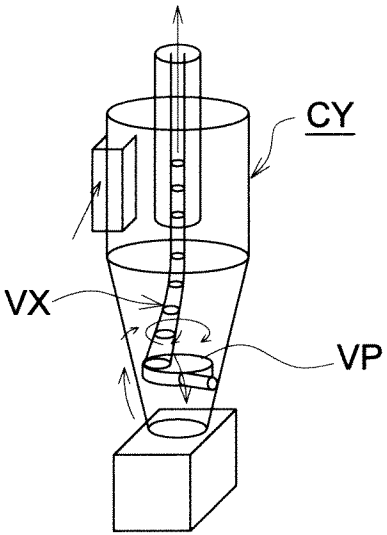
FIG. 10*d* shows the vortex table attached to the normal cyclone separator.

In addition, vortex table VP is applicable to normal cyclone separator CY, exhibiting a circular cone, which is shown in FIG. 10*d*.

Figure 11A:
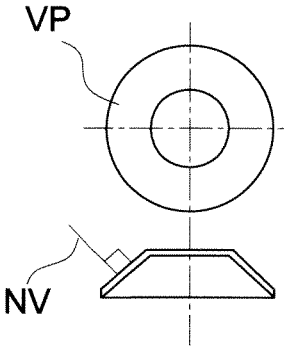
FIGS. 11*a*, 11*b* and 11*c* show various shapes of the vortex tables.
Figure 11B:
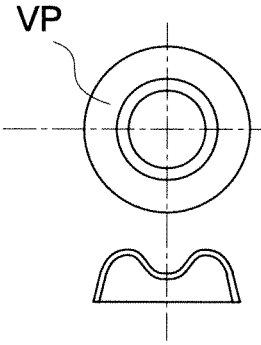
Figure 11C:
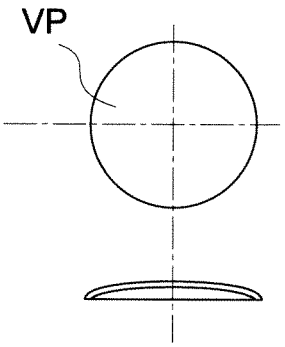

FIG. 11 shows various vortex tabes VP, illustrating the top views and the cross-sectional views. Said plates VP exhibit circler shapes in the top view. FIG. 11*a* shows a plate like a circular truncated cone, FIG. 11*b* shows a plate of a round cone having a concave portion, and FIG. 11*c* shows a plate like a plane-convex lens.

Each plate has a slope, sliding in the direction of gravitational force, around its circumference. That is, normal vector NV exhibits an acute angle against the direction of gravitational force, and normal vector NV extends in the direction opposing the direction of gravitational force. Further, the area of vortex tables VP is formed to be less than that of the opening of toner particle collection box BX.

Due to the above-described structure of vortex tables VP, the toner particles, having been separated from the air, are not accumulated on the slope, and drop into toner particle collection box BX, through the clearance between vortex tables VP and the opening of toner particle collection box BX.

Further, opening VH is formed in the surface of vortex table VP, so that the toner particles effectively drop through opening VH into the toner particle collection box. Said opening VH will be detailed while referring to FIG. 12, in which the cross-sectional view of vortex table VP is partially illustrated on the left, while the top view is illustrated on the right. Opening VH is provided between the central axis and the slope of the circumference of vortex table VP.

Figure 12A:
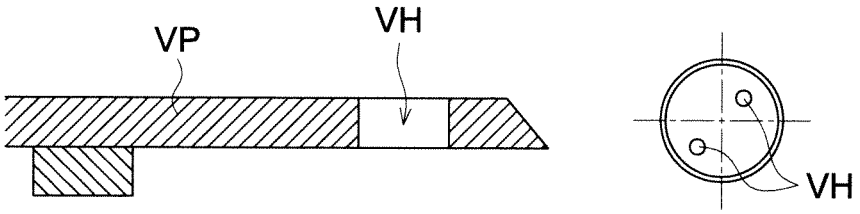
FIGS. 12*a* and 12*b* show openings, formed on the vortex table.
Figure 12B:
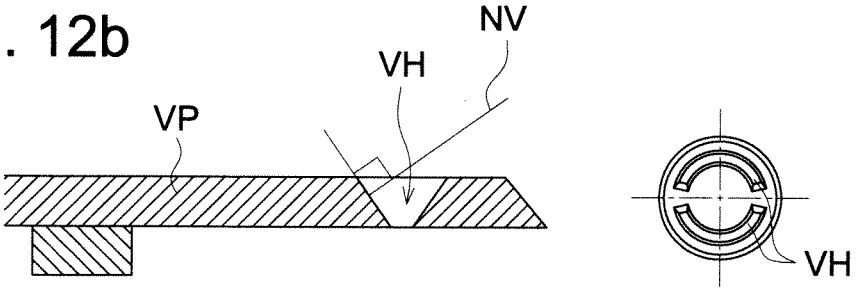

Concerning the area of opening VH, the area on the front surface is equal to the reverse surface (see FIG. 12*a*), but a mortar shape, shown in FIG. 12*b*, is more effective. Due to the mortar shape, the toner particles may not accumulate on the mortar slope, whereby though the effect of stabilization of the vortex core is not decreased, the area of the opening can be increased. In this case, the normal vector at an inner surface of the mortar slope exhibits a sharp angle against the direction of the gravitational force, and extends in the direction opposing to the gravitational force.

Further, openings VH are formed to be small holes, as shown in the plane view of FIG. 12*a*, but as shown in the plane view of FIG. 12*b*, circular grooves formed around the center axis of vortex table VP are effective. The number of openings VH is not limited to one, and plural openings VP are more effective.

Due to vortex table VP detailed above, vortex core VX conducts the precession movement on the surface of vortex table VP, whereby vortex core VX becomes stable, and the bottom portion of vortex core VX does not enter toner particle collection box BX. In the present embodiment, in order to prevent toner particles from flying again from toner particle collection box BX, baffle SS is provided in toner particle collection box BX, whereby the swirl flow is effectively controlled.

Figure 13A:
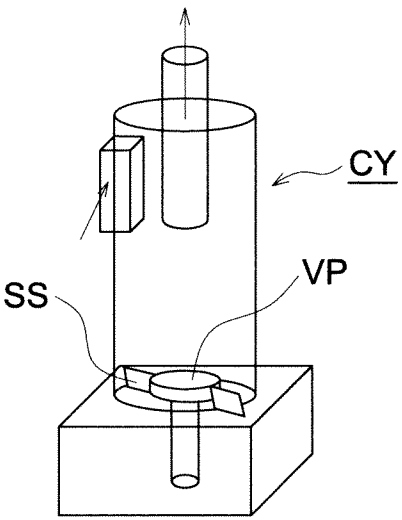
FIG. 13*a* is a perspective view of the cyclone separator using a baffle.

FIG. 13*a* is a perspective view of the cyclone separator using baffle VP, wherein baffle SS is provided between vortex table VP and the inner surface of the opening of toner particle collection box BX. Baffle SS is fundamentally formed to be a plate, a fusiform-shaped plate, as viewed in the cross-section, can be used as shown in FIG. 13*b*.

Figure 13B:
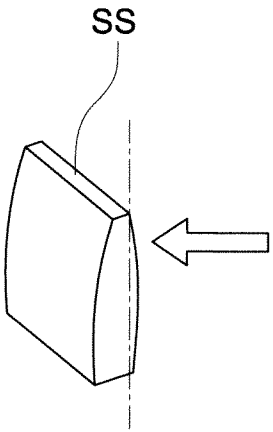
FIGS. 13*b* and 13*c* are schematic views to explain the baffles.
Figure 13C:
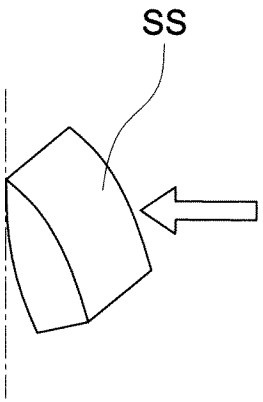
Figure 13D:
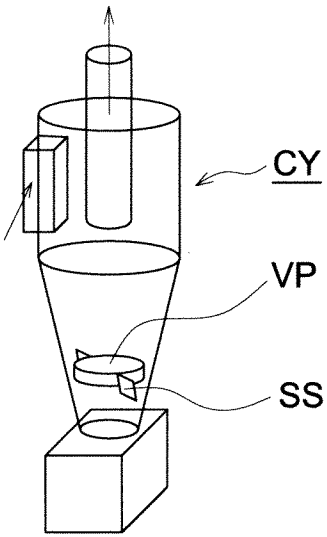
FIG. 13*d* is a perspective view of the normal cyclone separator using the baffle.

Concerning an angle for assembling baffle SS onto vortex table VP, said angle is adjusted so that a surface facing the swirl air is parallel to the direction of the gravitational force, as shown in FIG. 13*b*, or the top surface facing the swirl air is slightly declined as shown in FIG. 13*c*. Arrows illustrated in FIGS. 13*a* and 13*b* show the vector of the swirl flow, near baffle SS.

Since baffle SS effectively controls the airflow in toner particle collection box BX, the toner particles, having been collected, are prevented from flying again. In addition, baffle SS can be applied onto the normal cyclone separator, exhibiting a funnel shape in its lower section.

Figure 14:
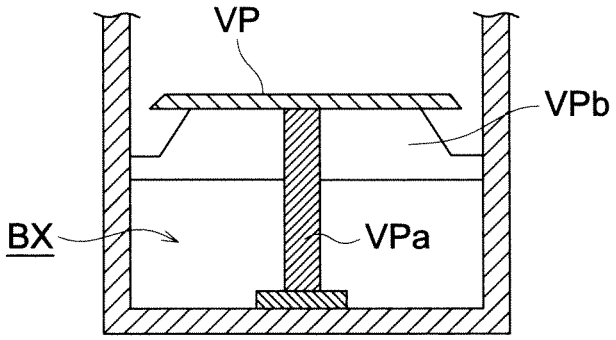
FIG. 14 is a cross-sectional view to show an installation method of the vortex table.

A method for assembling said vortex table VP will now be detailed. Firstly, pole section VPa, extending to the bottom of toner particle collection box BX, and supporting section VPb, extending horizontally from pole section VPa, are mounted on vortex table VP, as shown in FIG. 14. Said supporting section VPb is then fixed to the inner surface of toner particle collection box BX, so that vortex table VP can be stably fixed to the interior of toner particle collection box BX.

FIG. 4*b* shows the vortex table, which is fixed by the above-described method. That is, after vortex table VP, pole section VPa, and supporting section VPb are integrally formed, they are assembled in toner particle receiving container BX. As another method for fixing the vortex table, firstly, baffle SS is structured to connect to vortex table VP and the inner surface of the opening of toner particle collection box BX. After that, vortex table VP is fixed to baffle SS.

FIG. 15 shows various sealing members for closing air flow inlet 21 of the cyclone separator, wherein when the toner particle collection box is to be removed from the apparatus, toner particles are prevented from escaping from the apparatus by said sealing members.

Figure 15A:
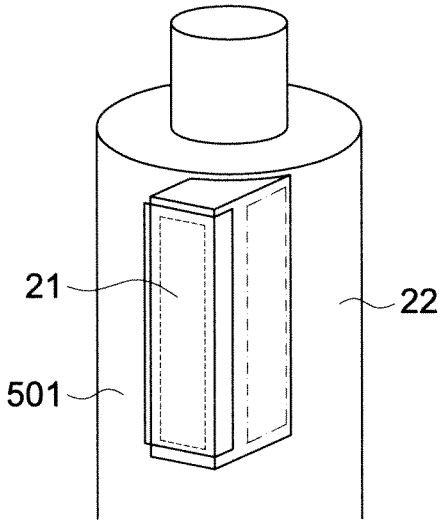
FIG. 15*a* shows a first example.

A first example is shown in FIG. 15*a*. Peelable sealing sheets 501 are adhered on the side portion of air flow inlet 21 and the peripheral surface of cyclone main body 22. When the toner particle collecting unit is removed from the apparatus, said sheets 501 are peeled off, and they close the air flow inlet. That is, an adhesive member, exhibiting low adhesion force, is applied to one of the surfaces of sealing sheet 501, and said sheet 501 is temporarily adhered to the side portion of air flow inlet 21, as shown by the alternate long and short dashed lines in FIG. 15*a*. If only the adhesive member adheres to the periphery of air flow inlet 21, closing function becomes effective, so that the adhesive member may be applied to four sides of sealing sheet 501.

Figure 15B:
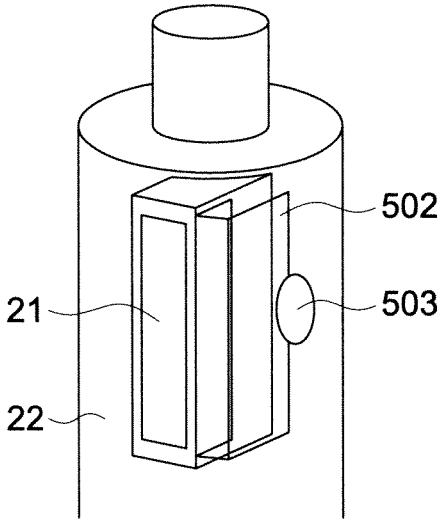
FIG. 15*b* shows a second example.
Figure 15C:
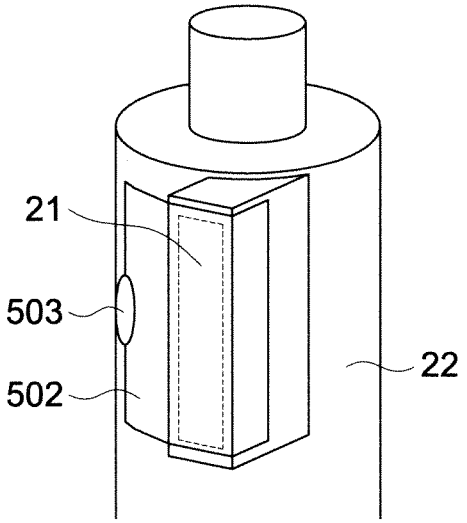
FIG. 15*c* shows a third example.

FIGS. 15*b* and 15*c* are the perspective views of FIG. 15*b* shows a condition before air flow inlet 21 is closed by sealing sheets 502, as a second example. FIG. 15*b* shows a condition before air flow inlet 21 is closed by sealing sheets 502, while FIG. 15*c* shows a condition after air flow inlet 21 is closed by sealing sheets 502. In FIG. 15*b*, approximately ¼ of sealing sheet 502 is attached to the side portion of air flow inlet 21, while ¾ of said sheet 502 are folded and fixed by adhesive patch 503 onto the side portion of air flow inlet 21. When the toner collecting unit is going to be removed from the apparatus, adhesive patch 503 is peeled off by the operator, and extended to the opposite side of the side portion (see FIG.

15*c*). Then sealing sheet 502 is pulled to the opposite side portion of air flow inlet 21, whereby air flow inlet 21 is closed by sealing sheet 502, and peeled adhesive patch 503 is adhered onto the surface of cyclone main body 22.

Since sealing sheets 501 and 502 are used in these embodiments, toner particles are prevented from dropping or flying, when the toner collecting unit is recovered. In addition, as the sealing member for closing air flow inlet 21, instead of the sealing sheet, a sealing cap is also effective, but the sealing sheet does not require a large space, and can be used easily to close the air flow inlet.

What is claimed is:

1. An image forming apparatus comprising:

a first air flow duct for guiding air including flying toner particles created in the image forming apparatus;

a second air flow duct having a fan for exhausting cleaned air to an exterior of the image forming apparatus; and a toner particle collecting unit arranged between the first air flow duct and the second air flow duct, wherein the toner particle collecting unit includes:

a cyclone separator including:

a cyclone main body, an air flow inlet, connected to the first air flow duct, for flowing the air including toner particles in a tangential direction of an inner surface of an upper portion of the cyclone main body, and an outlet tube for exhausting the cleaned air from which the toner particles have been separated, wherein the cyclone separator is configured to centrifuge the toner particles from the air including toner particles due to swirl flow generated in the cyclone main body, and exhausts the cleaned air through the outlet tube;

a toner particle collection box, mounted under the cyclone separator, for containing the toner particles having been separated from the air including toner particles;

an air channel section for guiding the cleaned air from the outlet tube to the second air flow duct; and a filter mounted on the air channel section, wherein the cyclone separator, the toner particle collection box, and the filter are structured to be integrally detachable from the image forming apparatus, wherein the filter is structured to be vertically long, and arranged in the air channel section to be parallel to the central axis of the cyclone separator, and wherein the outlet tube is connected to a U-shaped pipe.

2. The image forming apparatus of claim 1, wherein the toner particle collection box is located below the cyclone separator in the gravity direction.

3. The image forming apparatus of claim 1, wherein the cyclone main body is structured to be a cylindrical device from the top section to a connecting section to the toner particle collection box, wherein a vortex table for stabilizing a bottom edge of the vortex core in the swirl flow is arranged at a bottom of the cyclone separator, or at an inlet portion of the toner particle collection box.

4. The image forming apparatus of claim 3, wherein a top surface of the vortex table is structured to be a circle, and a center of the circle is arranged on a central axis of the cyclone main body.

5. The image forming apparatus of claim 4, wherein the vortex table includes a peripheral surface, which is structured to be a slope.

6. The image forming apparatus of claim 5, wherein the vortex table is structured to be a truncated cone.

7. The image forming apparatus of claim 5, wherein the vortex table is structured to be a semi-ellipsoid, as a cross-sectional view.

8. The image forming apparatus of one of claim 4, wherein the vortex table includes one or more openings penetrating in the direction of the gravitational force.

9. The image forming apparatus of claim 8, wherein the normal vector at an inner surface of the opening penetrating in the direction of the gravitational force exhibits a sharp angle against the direction of the gravitational force, and extends in the direction opposing the gravitational force.

10. The image forming apparatus of claim 1, wherein the outlet tube is arranged parallel to the filter arranged in the air channel section.

11. The image forming apparatus of claim 1, wherein the toner particle collecting unit, structured to be cubic, includes a handle or a knob on its front surface, for drawing it out.

12. The image forming apparatus of claim 1, wherein the toner particle collecting unit includes a sealing member to close the air flow inlet while the toner particle collecting unit is drawn out.

13. The image forming apparatus of claim 12, wherein, the sealing member comprises a sealing sheet having an adhesive member, which works in such ways that, when the toner particle collecting unit is mounted in the image forming apparatus, the sealing sheet is fixed at a position at which the sealing member does not close the air flow inlet, and when the toner particle collecting unit is drawn out from the image forming apparatus, the sealing sheet is spread so as to close the air flow inlet.

14. The image forming apparatus of claim 1, wherein the filter is structured of plural filters, including a toner particle-proof filter and an ozone catalytic filter, wherein the toner particle-proof filter is arranged at a most downstream side with respect to a direction of air flow, wherein a transparent window is arranged in the surface of the toner particle collecting unit so that through the transparent window, an operator visually check the toner particle-proof filter arranged at the most downstream side with respect to the direction of the air flow.

15. An image forming apparatus comprising:

a first air flow duct for guiding air including flying toner particles created in the image forming apparatus;

a second air flow duct having a fan for exhausting cleaned air to an exterior of the image forming apparatus; and a toner particle collecting unit arranged between the first air flow duct and the second air flow duct, wherein the toner particle collecting unit includes:

a cyclone separator including:

a cyclone main body, an air flow inlet, connected to the first air flow duct, for flowing the air including toner particles in a tangential direction of an inner surface of an upper portion of the cyclone main body, and an outlet tube for exhausting the cleaned air, from which the toner particles have been separated, wherein the cyclone separator is configured to centrifuge the toner particles from the air including toner particles due to swirl flow generated in the cyclone main body, and exhausts the cleaned air through the outlet tube; and a toner particle collection box, mounted under the cyclone separator, for containing the toner particles having been separated from the air including toner particles;

wherein the toner particle collection unit is structured to be integrally detachable from the image forming apparatus, wherein the cyclone main body is structured to be a cylindrical device from the top section to a connecting section to the toner particle collection box, wherein a vortex table for stabilizing a bottom edge of the vortex core in the swirl flow is arranged at a bottom of the cyclone separator, or at an inlet portion of the toner particle collection box, wherein a baffle, for decreasing the swirl flow in the toner particle collection box, is provided between the vortex table and an inner surface of the toner particle collection box.

16. The image forming apparatus of claim 15, wherein the baffle is installed so that a surface to face the swirl flow makes a sharp angle with the direction of the gravitational force.

17. The image forming apparatus of claim 16, wherein the vortex table and the baffle are designed in a monocoque structure.

18. The image forming apparatus of claim 15, wherein the vortex table and the baffle are designed in a monocoque structure.

* * * * *